US005884912A

United States Patent [19]

Ignatiev

[11] Patent Number: 5,884,912

[45] **Date of Patent: *Mar. 23, 1999**

[54] CYLINDRICAL LABYRINTH PUZZLE TOY

[76] Inventor: Alexander G. Ignatiev, 438 E. Ninth Ave. #208, Anchorage, Ak. 99501

[ * ] Notice: The terminal 39 months of this patent has been disclaimed.

[21] Appl. No.: 248,394

[22] Filed: May 24, 1994

[51] Int. Cl.[6] ..... A63F 9/08

[52] U.S. Cl. ..... 273/153 S

[58] Field of Search ..... 273/153 R, 153 S, 273/155, 156

[56] References Cited

U.S. PATENT DOCUMENTS

| | | | |
|---|---|---|---|
| D. 274,074 | 5/1984 | Brunko | 273/155 X |
| 3,594,005 | 7/1971 | Vennola | 273/153 R |
| 3,819,187 | 6/1974 | Downs | 273/156 |
| 3,820,793 | 6/1974 | Palmer | 273/153 R |
| 5,281,039 | 1/1994 | Hsiung et al. | 401/195 |

*Primary Examiner*—William H. Grieb

[57] ABSTRACT

A thing for amusement related to a puzzle or maze which has cylindrical body with a labyrinth's relief. The labyrinths Picture may be changed by revolving and rearranging the cylindrical sections (11). Cylindrical labyrinth has one or more guide-rings (40), (50) for leading guide-element (41), (51) along the chutes (25) from start to finish point. Guide-rings have catch elements (42), (52) for joining each other.

1 Claim, 3 Drawing Sheets

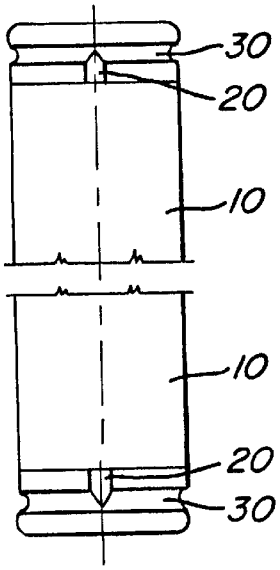
Fig 1.1
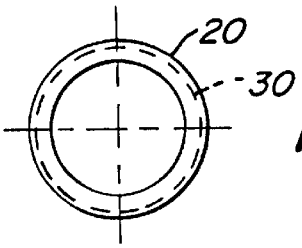
Fig_1.2
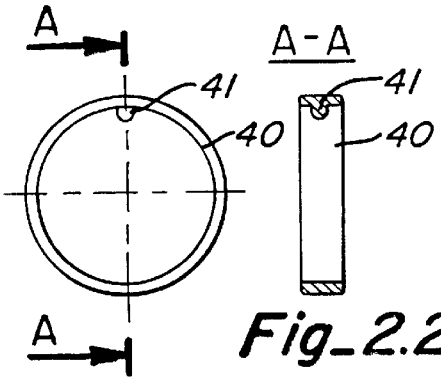
Fig_2.2
Fig_2.1
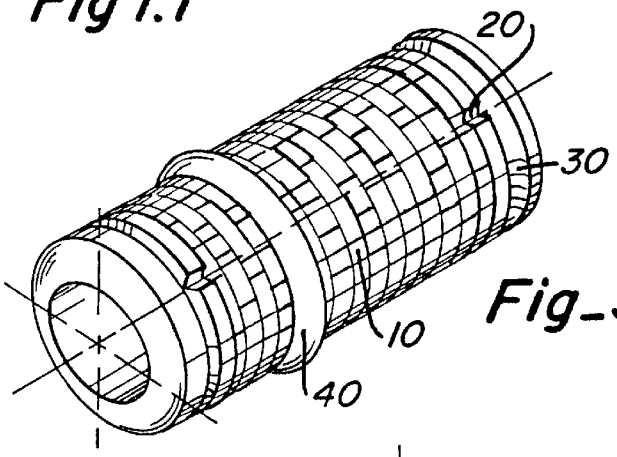
Fig_3
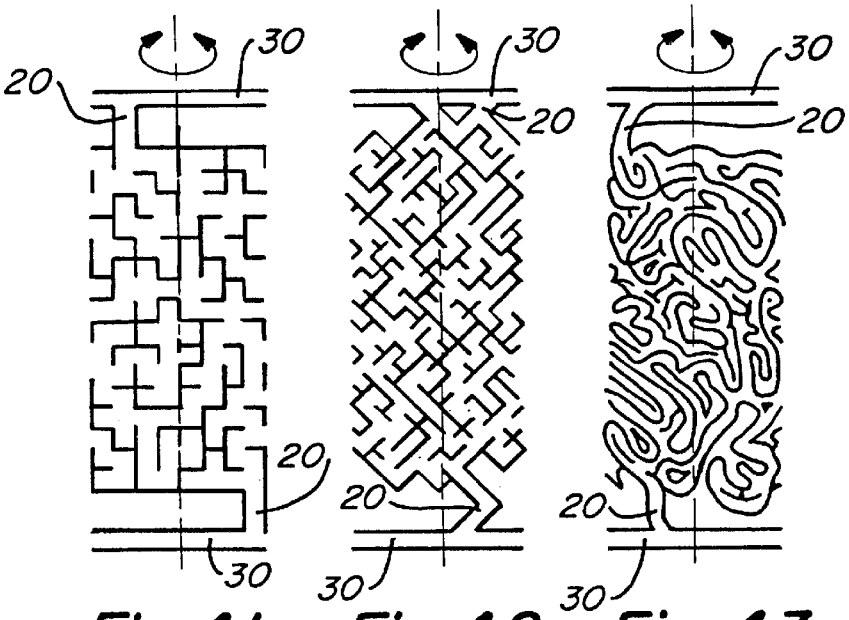
Fig_4.1 Fig_4.2 Fig_4.3

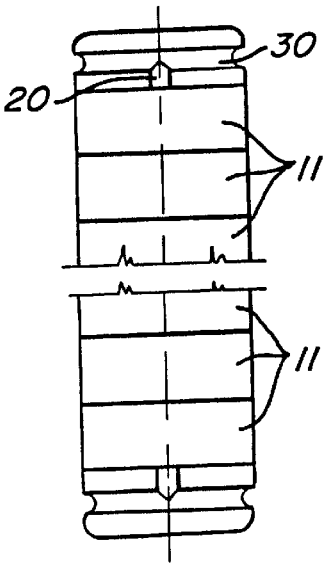
Fig_5. 1
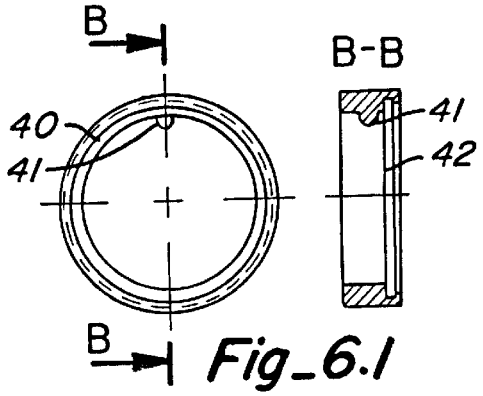
Fig_6.1
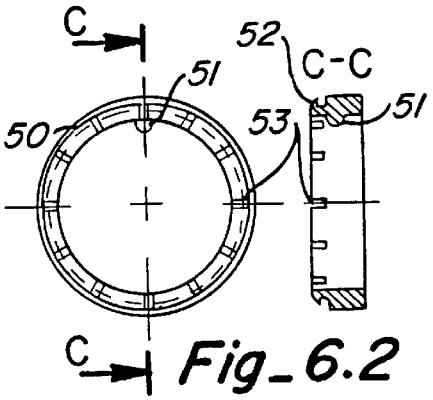
Fig_6.2
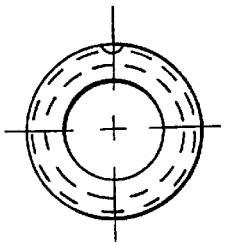
Fig_5.2
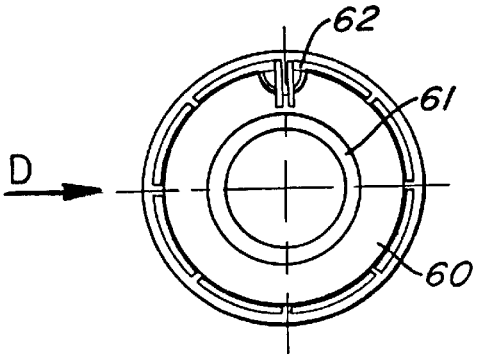
Fig_7.1
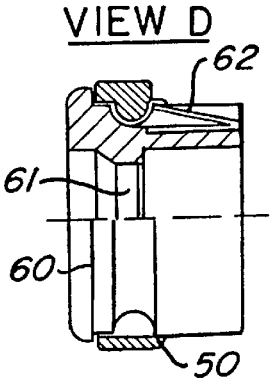
Fig_7.2

CYLINDRICAL LABYRINTH PUZZLE TOY

BACKGROUND

1. Field of the Invention

This invention relates to an amusement device, and more particularly to a labyrinth or maze amusement device.

2. Description of Prior Art

Labyrinths and mazes wherein, the object is to trace an unobstucted pathway from a starting point to a finish point through a maze of obstructions and pathyways are well known, popular forms of amusement.

However, the problem with most of these maze games is that they comprise a fixed maze, which offers little challenge after the player first successfuly clears the labyrinth's pathway from start to finish, i.e., the arrangement of the labyrinth is static. The author of U.S. Pat. No. 3,820,793 suggests changeable patterns for a two-measured labyrinth game. Some authors suggest complicting a labyrinth making it in three-measured subjects.

Moreover, different subjects which may be used for alternate purposes may be combined with each other. So, author of U.S. Pat. No. 5,281,039 sugests a pen with a toy labyrinth incorporated therein. Someone can convert it as a pen for writing and as a toy for fun.

OBJECTS AND ADVANTAGES

The present cylindrical labyrinth (CL), unite all advantages said tips of a labyrinth toys:

(a) it has a changeable labyrinth's picture;

(b) it is three-measured toy;

(c) it may be easily combined with other cylindrical subjects;

moreover;

(d) it is more complicated because part of the labyrinth's picture is hidden on a back side of the cylinder;

(e) it is more complicated because it has more than one guide-element.

DRAWING FIGURES

FIG. 1.1 and FIG. 1.2 are front view and view from above of the CL-3 body;

FIG. 2.1 and FIG. 2.2 are front and side views of guide-ring of CL-3;

FIG. 3 is a perspective view of the CL-3;

FIG. 4.1, FIG. 4.2 and FIG. 4.3 are plans of different sytles of labyrinth pictures;

FIG. 5.1 and FIG. 5.2 are front view and view from above of the CL-1 body;

FIG. 6.1 and FIG. 6.2 are fron and side views of the first and second guide-rings with circular catch elements;

FIG. 7.1 and FIG. 7.2 are front and side views of the final ring with the latch and second guide-ring;

REFERENCE NUMERALS IN DRAWINGS

10—bbasis barrel of CL body

11—cylinddrical sections

12—head of the basis barrel

13—catch of the basis barrel

20—start/finish chute

25—labyrinth's chute

30—circular chute

40-and 50—guide-rings

41-and 51—projection guide

42-and 52—elements of circular catch

53—slots

60—final ring

61—circular stopper

62—latch

DESCRIPTION OF THE PREFERRED EMBODIMENT

Figure 8:
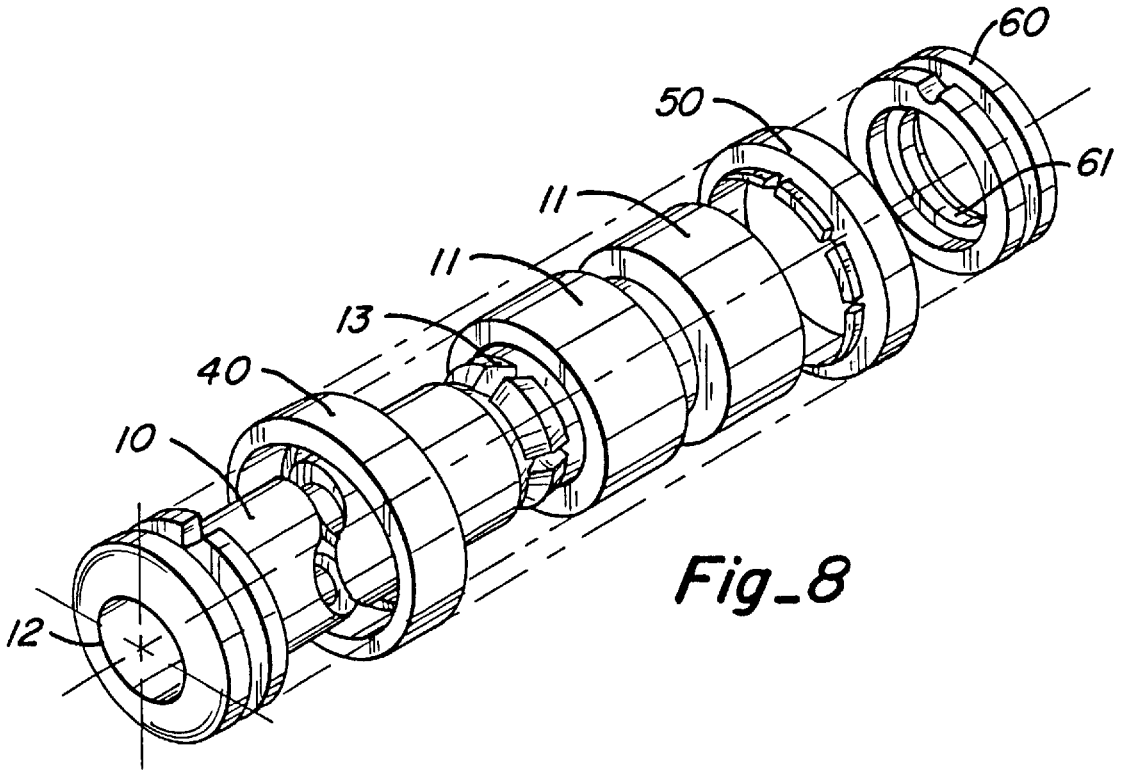
FIG. 8 is a perspective view of the CL-1 assembly.
Figure 9:
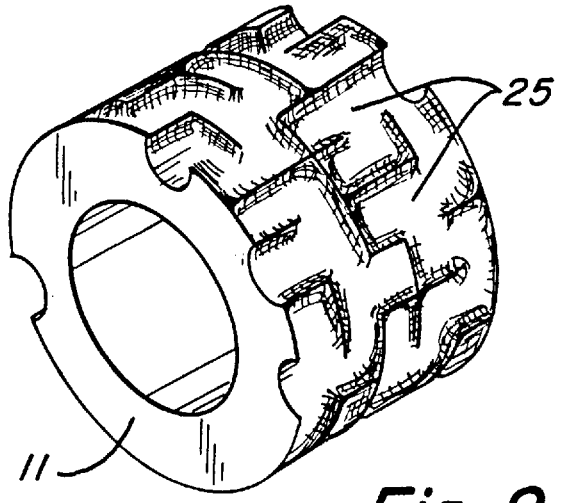
FIG. 9 is a perspective view of a CL-1 circular section.

The preferred embodiment of CL is shown on FIG. 8. The example CL is shown with only one pair of guide rings, 40 and 50, and a couple of cylindrical sectins 11. The actual CL may have more or less of them.

CL-1 may be assembled by this example; first the basis barrel (10) which has head (12) fits on a starting guide-ring (40); next, fit the whole set of cylindrical sections (11). Second (finish) guide-ring (50) fits on a final ring (60) and fixed there with latch (62), then guide-ring (50) fits on catch (13) of basis barrel and attaches there with stopper (61). CL is ready to play.

The labyrinth field is a system of 25 chutes which cover the cylinders surface and create a labyrinthine picture. The style of labyrinth picture may differ. For example FIGS. 4.1, 4.2 and 4.3.

The cylinder with the labyrinth picture is divided into one or more cylindrical sections 11. The said sections can revolve independently from each other around basis barrel 10, changing the labyrinth's picture. Running the labyrinth from start to finish with a starting guie-ring 40, a player can then join the second guide-ring 50 with catch elements 42 and 52. The catch elements 42 and 52 after attaching to the guide-rings allows them to revolve independently from each other in parallel rotations.

When said guide-rings are attached to each other latch 62 releases the second ring because the first one pushes it down. With a couple of guide-rings a player can try clearing the labyrinth backwards from finish to start with couple guide-rings. Addinig a third guide ring allows the player to run the labyrinth a third time, and so on. The addition of more guide rings effectivly changes the clear pathway of the labyrinth, making it a different, more challenging game each time.

SUMMARY, RAMIFICATIONS, SCOPE

According to the present cylindrical labyrinth, a maze device is provided, the pattern of which can be easily and repeatedly changed. The labyrinth's field is placed on cylindrical sections each one can easily revolve around the CL basis barrel. Due to this fact, a new labyrinth is presented to the player with each rotation.

The CL has one or more guide-rings for moving a guide-element along the labyrinth chutes.

The guide-rings, if more than one, have a catch to join each other. This catch lets the guide-rings revolve in parallel rotation. The distance between the guide-elements when the guide-rings are joined must be equal to the distance between the neighboring chutes which are situated in parallel planes and perpendicular to the CL axis.

The present CL assumes several varieties of design:

CL-1 the preferred CL embodiment, has several revolving and arrangeable sections of labyrinth picture;

CL-2 is CL with several revolving, unrearrangeable sections of labyrinth picture;

CL-3 is CL with one revolving section of labyrinth picture;

All of said designs can have one or more guide-rings and differening labyrinthine pictures.

I claim:

1. A cylindrical labyrinth amusement device comprising;

a barrel;

a cylinder mounted on said barrel, said cylinder divided into a plurality of sections, each of said sections having a maze of recessed portions on their outer surfaces, which, taken together, make up a labyrinth picture;

said sections are able to be turned independently of each other for changing the labyrinth picture;

and at least two rings mounted on said cylinder, said rings having means to engage with the recessed portions of the cylinder sections to permit the rings traverse the labyrinth;

said rings having means to link the rings together, said means allowing the rings to turn independently of each other in a moment when they are linked to traverse the labyrinth's way together.

* * * * *